US011655571B2

(12) United States Patent
Frey et al.

(10) Patent No.: US 11,655,571 B2
(45) Date of Patent: May 23, 2023

(54) NONWOVEN WEB AND METHOD OF MAKING SAME

(71) Applicants: Detlef Frey, Niederkassel (DE); Hans-Georg Geus, Niederkassel (DE); Michael Maas, Roesrath (DE); Martin Neuenhofer, Roesrath (DE); Michael Nitschke, Koenigswinter (DE); Christine Noack, Cologne (DE); Hartmut Kopp, Troisdorf (DE)

(72) Inventors: Detlef Frey, Niederkassel (DE); Hans-Georg Geus, Niederkassel (DE); Michael Maas, Roesrath (DE); Martin Neuenhofer, Roesrath (DE); Michael Nitschke, Koenigswinter (DE); Christine Noack, Cologne (DE); Hartmut Kopp, Troisdorf (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 865 days.

(21) Appl. No.: 16/587,105

(22) Filed: Sep. 30, 2019

(65) Prior Publication Data

US 2020/0157715 A1 May 21, 2020

(30) Foreign Application Priority Data

Sep. 28, 2018 (EP) ..... 18197791

(51) Int. Cl.
*D04H 1/44* (2006.01)
*D04H 1/559* (2012.01)
(Continued)

(52) U.S. Cl.
CPC ..... *D04H 1/44* (2013.01); *D01D 5/08* (2013.01); *D01D 5/0985* (2013.01); *D01H 3/00* (2013.01);
(Continued)

(58) Field of Classification Search
CPC D21G 1/00; D04H 3/16; D04H 1/559; D04H 1/724; D04H 3/14; D04H 1/64;
(Continued)

(56) References Cited

U.S. PATENT DOCUMENTS 3,824,387 A * 7/1974 Garst ..... C03C 25/12 700/74
2005/0095943 A1* 5/2005 Griffin ..... B29C 43/26 442/352
2005/0176330 A1* 8/2005 Hama ..... B32B 27/281 442/411

FOREIGN PATENT DOCUMENTS

JP 2021025188 * 2/2021 ..... D04H 3/16

* cited by examiner

*Primary Examiner* — Monica A Huson
(74) *Attorney, Agent, or Firm* — Andrew Wilford

(57) ABSTRACT

A nonwoven web is made by first depositing fibers as a nonwoven web in a deposition area, then conveying the web away from the deposition area in a web-travel direction, preconsolidating the web in the path, and passing the preconsolidated web between a pair of rollers that compress and final consolidate the preconsolidated web, One of the rollers is separated from the web such that final consolidation of the web at a starting level is stopped and at the same time or immediately beforehand upstream preconsolidation of the web increased. After separating the one roller from the web, another roller is engaged with the web at the consolidation station and then final consolidation is recommenced, whereupon upstream preconsolidation of the web is reduced back to the starting level.

15 Claims, 1 Drawing Sheet

(51) Int. Cl.

| | |
|---|---|
| ***D04H 1/64*** | (2012.01) |
| ***D04H 1/724*** | (2012.01) |
| ***D21G 1/00*** | (2006.01) |
| ***D04H 3/14*** | (2012.01) |
| ***D01D 5/08*** | (2006.01) |
| ***D01D 5/098*** | (2006.01) |
| ***D01H 3/00*** | (2006.01) |
| ***D01H 3/16*** | (2006.01) |

(52) U.S. Cl.
CPC ..... *D01H 3/16* (2013.01); *D04H 1/559* (2013.01); *D04H 1/64* (2013.01); *D04H 1/724* (2013.01); *D04H 3/14* (2013.01); *D21G 1/00* (2013.01)

(58) Field of Classification Search
CPC .. D04H 1/44; D01H 3/16; D01H 3/00; D01D 5/0985; D01D 5/08
See application file for complete search history.

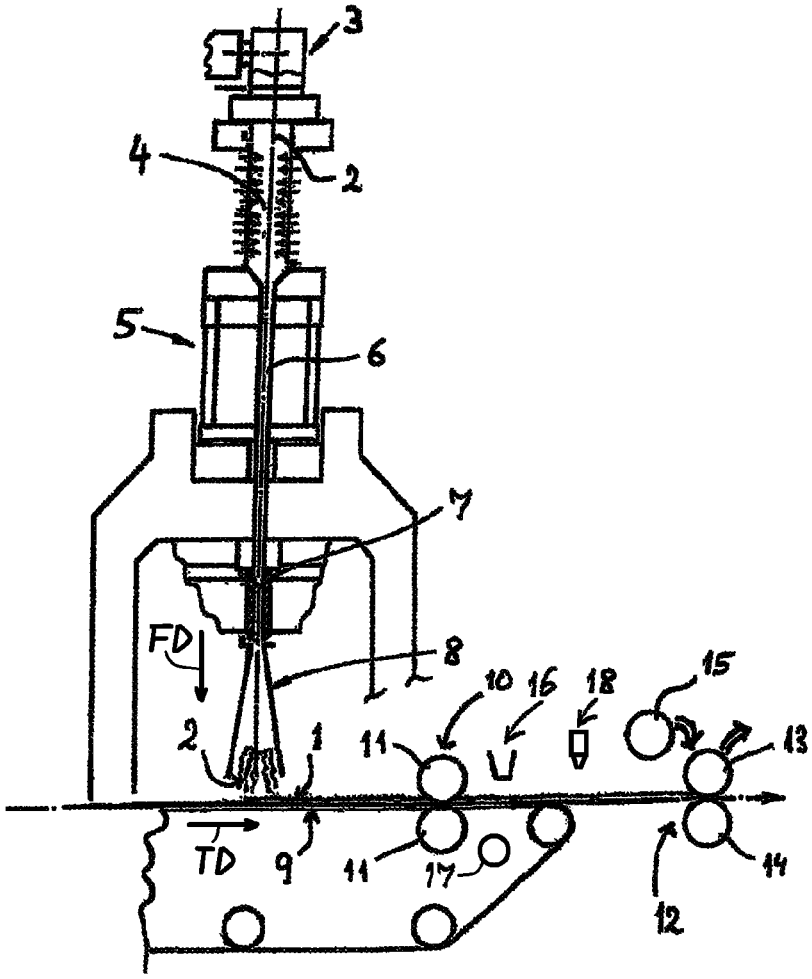
3
4
2
5
6
7
FD
8
10
16
18
15
2
1
11
13
TD
9
11
17
14
12

NONWOVEN WEB AND METHOD OF MAKING SAME

FIELD OF THE INVENTION

The present invention relates to a nonwoven. More particularly this invention concerns a method of and apparatus for making a nonwoven from fibers.

BACKGROUND OF THE INVENTION

A nonwoven web from fibers, particularly from plastic fibers, is typically made by spinning the fibers, then cooling them, and depositing them as a mat or nonwoven web in a deposition area, particularly on a deposition or screen belt. Then the mat passes through a preconsolidater then through a first calender-roller assembly. At the downstream end of the production line the thus preconsolidated and calendered nonwoven web is wound up, or otherwise processes for further use.

A method and apparatus of the above-described type are known from practice in various embodiments. When calendering the nonwoven web with a calender roller, the need can arise during operation to replace the calender roller. Such a case arises, for example, when the properties of the calender roller are to be modified in view of the nonwoven web to be produced. Such a case arises, for example, when the calender engraving is to be changed in order to vary the feel, softness, and appearance of the nonwoven web. Switching out calender rollers can also be performed due to wear of a calender roller. The problem with such an exchange of calender rollers is that it generally requires the current cycle of the system to be halted, resulting in disadvantageously long down times.

Concepts for solutions have already been proposed in which the upper calender roller that is to be exchanged from a pair of calender rollers is pivoted out, with a second upper calender roller being pivoted in against the lower calender roller in its place. Such a solution can shorten interruptions in the production of nonwoven webs. Nevertheless, the operation must be interrupted here as well, so that there is a down time during which calendering cannot be performed and thus no proper production of nonwovens can take place. Apart from that, this proposed concept for a solution is prone to faults and subject to constraints. There is therefore room for improvement in terms of the functionally reliable exchange of a calender roller.

OBJECTS OF THE INVENTION

It is therefore an object of the present invention to provide an improved method of making a nonwoven from fibers.

Another object is the provision of such an improved method of making a nonwoven from fibers that overcomes the above-given disadvantages, in particular that has a simple, efficient, and reliable procedure for calender-roller exchange during operation without stopping the apparatus.

Another object of the invention is to provide an apparatus for carrying out the method.

SUMMARY OF THE INVENTION

A nonwoven web is made by first depositing fibers as a nonwoven web in a deposition area, then conveying the web away from the deposition area in a web-travel direction, preconsolidating the web in the path, and passing the preconsolidated web between a pair of rollers that compress and final consolidate the preconsolidated web, One of the rollers is separated from the web such that final consolidation of the web at a starting level is stopped and at the same time or immediately beforehand upstream preconsolidation of the web increased. After separating the one roller from the web, another roller is engaged with the web at the consolidation station and then final consolidation is recommenced, whereupon upstream preconsolidation of the web is reduced back to the starting level.

Advantageously, interacting upper and lower calender rollers are used. The two calender rollers form a nip for pulling the nonwoven web downstream in a web-travel direction and consolidating it. At least one of calender rollers can be engraved, and at least one of the calender rollers is preferably heated. According to a preferred embodiment of the invention, the first upper calender roller of the pair of calender rollers is exchanged for a second upper calender roller. For this purpose, it is useful for the first upper calender roller to be pivoted out and thereby separated from the lower calender roller. The second upper calender roller is then preferably pivoted in to interact with the lower calender roller. The pivoting-in or pivoting-out of the calender rollers is advantageously performed by pivot mechanisms or levers or similar devices. The at least one pair of calender rollers functions as at least one final consolidation stage for the nonwoven web.

It thus lies within the scope of the invention for calender-roller exchange to take place on the fly, that is without interruption of the current process operation and, in particular, without interrupting travel of the nonwoven web. In the context of the invention, the nonwoven web can continue to be produced during calender-roller exchange and conveyed further without requiring a shutdown and restart of the associated devices.

The invention is based on the discovery that the conveying forces acting on the nonwoven web through the calender are immediately eliminated when a calender roller to be exchanged is removed and/or pivoted out. This has the effect that the further transport components of the apparatus must exert a substantially greater tension on the nonwoven web. Upon separation or pivoting-out of the calender roller, the mechanical properties of the nonwoven web change; in particular, its modulus of elasticity drops drastically. As a result, the elongation is much greater even with small forces. As a rule, these effects lead to disadvantageous changes in the properties of the nonwoven web produced and/or to the nonwoven web being damaged or torn if appropriate measures are not taken. The invention is now based on the discovery that, by virtue of the measures according to the invention, a continuation of the production and conveyance of the nonwoven web is possible without disadvantageously changing the nonwoven's properties and without the nonwoven web being damaged or torn. Surprisingly, this advantageous result can be achieved with very simple and less expensive measures by increasing the preconsolidation of the nonwoven web.

One especially preferred embodiment of the invention is characterized in that the fibers, more particularly the plastic fibers, are spun continuous fibers or filaments and, in particular, produced by a spinneret. Such continuous filaments differ from staple fibers on account of their quasi endless length, since staple fibers have substantially shorter lengths of for example 10 to 60 mm. According to a recommended embodiment of the invention, the filaments are spun as monocomponent filaments. One special embodiment of the method according to the invention is characterized in that bicomponent filaments or multicomponent filaments are spun as fibers or continuous filaments. Advantageously, the fibers or filaments are stretched before being deposited on the storage or screen deposition belt. According to a particularly recommended embodiment of the invention, the fibers are spun as continuous filaments and produced as a spun-consolidated nonwoven web or as a melt-blown nonwoven web. Multi-beam systems or multi-beam devices can be readily used in the context of the invention.

According to the invention, the preconsolidation of the nonwoven web is increased during calender-roller exchange. Advantageously, the preconsolidating effect is increased before, more particularly shortly before separation of the first calender from the nonwoven web. After the second calender roller is installed, it lies within the scope of the invention for the preconsolidation of the nonwoven web to be reduced again and, in particular, to the preconsolidation level used before calender-roller exchange or before the increase of preconsolidation. In this respect, the invention is based on the discovery that a smooth roller exchange is possible during nonwoven production with this approach.

According to a recommended embodiment, the preconsolidater has at least one pressure roller or heated pressure roller that acts on the nonwoven web. Preferably, the preconsolidating effect applied by the pressure roller is increased before or during calender-roller exchange by preferably increasing the temperature and/or the compaction pressure or the line pressure of the pressure roller for this purpose. The temperature is advantageously set by a controller. The compaction pressure or line pressure can be selected by mechanical, pneumatic, or electromechanical means. It lies within the scope of the invention for the preconsolidation done by the pressure roller to be reduced again after calender-roller exchange, particularly to the lower level used for preconsolidating, more particularly to approximately the value of the preconsolidation before the increase of preconsolidation during calender-roller exchange.

According to a preferred embodiment of the invention, the preconsolidater has at least one additional preconsolidating component. Advantageously, this at least one additional preconsolidating component is activated (shortly) before calender-roller exchange for additional preconsolidation of the nonwoven web. It is recommended that the preconsolidation with the at least one additional preconsolidating component be deactivated again after calender-roller exchange, specifically that preconsolidation be reduced again to the level before calender-roller exchange.

According to one design variant of the invention, the at least one additional preconsolidating component is at least one press roller that is brought into contact with the nonwoven web (immediately) before calender-roller exchange for additional preconsolidation of the nonwoven web. It lies within the scope of the invention for a pair of press rollers to be caused to engage with the nonwoven web as an additional preconsolidating component (shortly) before calender-roller exchange for additional preconsolidation of the nonwoven web. An alternative or additional design variant is characterized in that the at least one additional preconsolidating component is an adhesive applicator, specifically a spray adhesive applicator. It is useful for adhesive, more particularly spray adhesive, to be additionally applied to the nonwoven web starting (shortly) before calender-roller exchange for the additional preconsolidation of the nonwoven web. Alternatively or in addition, a hot-air final consolidater is provided as an additional preconsolidating component with which hot air is applied to the nonwoven web for the additional preconsolidating (shortly) before calender-roller exchange. It lies within the scope of the invention for such a preconsolidating component or preconsolidating components to be deactivated again after calender-roller exchange and for the preconsolidating to be advantageously reduced to or approximately to the preconsolidating level before calender-roller exchange or before the additional preconsolidating.

According to one recommended embodiment of the invention, in addition to the intensification of the preconsolidating, the web-travel speed of the nonwoven web or the line speed is increased for the duration of calender-roller exchange. One especially preferred embodiment of the invention is characterized in that the web-travel speed of the nonwoven web between the deposition area and a receiving device for the nonwoven web, particularly a winder for coiling the nonwoven web, is increased during calender-roller exchange. According to an especially recommended embodiment, in addition to increasing the preconsolidation, only the web-travel speed of the nonwoven web is increased and further system parameters or apparatus parameters are not changed or substantially changed during calender-roller exchange. In principle, however, other system parameters could also be changed during calender-roller exchange. A "roller change" mode can be selected appropriately in a controller for this purpose. The system parameters or apparatus parameters to be changed are defined in this operating mode and can be preferably transferred to the apparatus in a program-controlled manner.

As already indicated above, with respect to the nonwoven web-travel speed (web-travel speed), the invention is based on the discovery that, after the separation of the first calender roller and before the second calender roller is installed, the transporting forces applied by the calender to the nonwoven web drop abruptly. Accordingly, the system components that are acting on the nonwoven web must provide a greater tension. If this does not occur, sagging of the nonwoven web is often the result. In order to provide a possibility for compensation in this regard, according to a preferred embodiment of the invention, in addition to increasing the preconsolidating effect, the web-travel speed of the nonwoven web is increased during calender-roller exchange in order to increase the preconsolidating effect, while preferably no other system parameters are changed, or as few as possible. Advantageously, the web-travel speed is reduced again after calender-roller exchange, particularly to the web-travel speed or approximately to the web-travel speed before calender-roller exchange.

During or before calender-roller exchange, it lies within the scope of the invention to increase the rotational speed of at least a portion of the rotating system components that are provided between the deposition area and the receiving device or winder and in contact with the nonwoven web, particularly rolls or rollers. According to one embodiment, the rotational speed of all these rotating system components is increased in order to increase the web-travel speed. In addition to increasing the preconsolidation, it lies within the scope of the invention for all of the drives of the apparatus according to the invention that are responsible for the nonwoven web-travel speed to be adjusted such that the nonwoven web-travel speed is appropriately increased. In order to support these measures, a nonwoven web portion is spooled continuously in a compensator unit with at least one dancer roller when the web-travel speed is increased. This measure ensures that a certain length of nonwoven web can be accommodated temporarily in the compensator unit during the calender exchange and after increasing of the web-travel speed. The tension of the nonwoven web is advantageously measured and/or monitored during calender-roller exchange, and the system components or drives that determine the nonwoven web-travel speed are controlled with or without feedback as a function of this.

As an alternative or in addition to increasing the web-travel speed during calender-roller exchange, it is also possible to work with a starter web (a so-called "leader") during calender-roller exchange. For this purpose, an already final consolidated length of starter web is fed into the apparatus and the fibers are applied to and/or wound on this starter web. Appropriately, calender-roller exchange begins when the starter web has reached the apparatus's downstream end or the winder for the nonwoven web. With this approach, it is possible in principle to dispense with increasing the web-travel speed during calender-roller exchange.

During normal operation, a portion of the transporting forces is taken over by the calender rollers during production of the nonwoven web. If no calendering takes place during calender-roller exchange, this portion of the transporting forces applied by the calender is eliminated. The invention is based on the discovery that, during calender-roller exchange, this missing portion of the forces or transporting forces must be provided or compensated for by additional measures.

It lies within the scope of the invention for a screen deposition belt to be used as a deposition area for the fibers and for the nonwoven web to be advantageously stripped from the screen deposition belt before being transferred to the at least one calender roller. Preferably, the separation of the nonwoven web is assisted during calender-roller exchange by an additional stripper. One embodiment of the invention that has proven advantageous is characterized in that, in order to aid separation of the nonwoven web from the deposition belt or the screen deposition belt during calender-roller exchange, at least one additional take-off roller is activated and brought into contact with the nonwoven web. According to a preferred embodiment, the additional take-off roller is brought into contact with a, preferably already previously active, cooling roll for cooling the nonwoven web in order to form a take-off nip for the nonwoven web. It lies within the scope of the invention for cooling rolls to be provided downstream of the screen deposition belt, and advantageously of the calender, during production of the nonwoven web, the cooling rolls being preferably embodied as an S-type roller take-off. According to a recommended embodiment of the invention, in order to assist in the separation of the nonwoven web from the screen deposition belt, an additional take-off roller is provided above the first upper roll or cooling roll of the S-type roller take-off assembly and lowered onto the upper roll or cooling roll in preparation for and during calender-roller exchange, thus advantageously forming a take-off nip that assists separation of the nonwoven web from the deposition belt or screen deposition belt.

According to a recommended embodiment of the invention, calender-roller exchange is performed at a nonwoven web-travel speed of from 80 to 400 m/min, preferably 100 to 350 m/min, and very preferably 100 to 300 m/min. This time window has proven to be especially advantageous in the context of the method according to the invention.

After completion of calender-roller exchange, it lies within the scope of the invention for the apparatus parameters that were changed in preparation for or during calender-roller exchange to be reset again or adapted again to normal operation. During the completion of calender-roller exchange, the calender rollers used for the subsequent calendering are advantageously accelerated to the nonwoven web-travel or screen-belt speed, preferably also with an adjustable overfeed, and then moved together and subjected to pressure. Nonwoven web production is then preferably continued with the original process and/or apparatus parameters.

It is also the object of the invention to provide an apparatus for making a nonwoven web from fibers, preferably from plastic fibers, and especially preferably from continuous filaments composed of plastic fibers, comprising a spinning device or a spinneret for spinning the fibers and a cooler for cooling the fibers as well as a deposition area for depositing the fibers to form the nonwoven web, wherein at least one preconsolidater is provided for preconsolidating the nonwoven web, as well as at least one first calender roller that is downstream from the preconsolidater for consolidating the nonwoven web, and at least one calender-roller exchange device is provided for exchange the first calender roller with a second calender roller, the apparatus further comprising:

at least one controller for controlling with or without feedback the preconsolidation, and preferably for controlling with or without feedback the web-travel speed of the nonwoven web and/or the web tension of the nonwoven web during calender-roller exchange, and/or at least one additional preconsolidating component for additional preconsolidation of the nonwoven web during calender-roller exchange, and/or at least one stripper for assisting separation of the nonwoven web from the screen deposition belt during calender-roller exchange.

It was already pointed out above that, according to a preferred embodiment of the invention, the method according to the invention is carried out as a spin-consolidation process for making a spun-consolidated nonwoven. In the context of a corresponding spin-consolidating apparatus for making such a spun-consolidated nonwoven or a spun-consolidated nonwoven web, continuous filaments are first spun by at least one spinneret and then cooled in a cooler. The filaments then pass through a stretcher for stretching the filaments. The stretched filaments are deposited in a deposition area, particularly on a deposition belt or screen deposition belt, as a nonwoven web or as a spun-consolidated nonwoven.

In this context, one especially preferred embodiment of the invention is characterized in that the assembly composed of the cooler and the stretcher is a closed unit with no additional air being supplied to the unit other than the cooling air that is supplied in the cooler. Advantageously, at least one diffuser is interposed between the stretcher and the deposition area, particularly the deposition belt or screen deposition belt. The fibers or continuous filaments emerging from the stretcher are passed through this diffuser and then deposited in the deposition area, particularly onto the deposition belt or screen deposition belt. This is followed by preconsolidating and consolidating by calendering.

Another recommended embodiment of the invention is characterized in that the method according to the invention is carried out as a melt-blown process and a melt-blown nonwoven fabric is produced. In principle, nonwoven webs of bicomponent filaments or multicomponent filaments can be produced in the context of the invention. The inventive measures are also outstandingly suited for such nonwoven webs in particular. It also lies within the scope of the invention for fibers or filaments of thermoplastic material to be produced by the method according to the invention. The plastic of the plastic fibers is preferably a polyolefin, particularly polyethylene and/or polypropylene. In principle, however, it is also possible for other thermoplastics to be used to make the fibers or filaments of the nonwoven web according to the invention.

The invention is based on the discovery that a simple and rapid calender-roller exchange is possible in the context of the method according to the invention and with the apparatus according to the invention without the need to interrupt the production cycle of the nonwoven web. The measures according to the invention are able to ensure continuous production of the nonwoven web. The measures according to the invention that are required for this purpose are characterized by simplicity and low cost. The additional preconsolidation according to the invention can be carried out quickly and without problems. The measures to be taken for the calender exchange are either relatively simple control measures employing the addition of simple additional system components. In the context of the method according to the invention, a smooth transition from normal nonwoven production to calender-roller exchange as well as an equally smooth transition from calender-roller exchange back to normal operation is possible. With the aid of the measures according to the invention, these transitions can be performed without interference or constraints. As a result, the method according to the invention and the apparatus according to the invention are characterized by simplicity, minimal effort, and low cost.

BRIEF DESCRIPTION OF THE DRAWING

The above and other objects, features, and advantages will become more readily apparent from the following description, reference being made to the accompanying drawing whose sole FIGURES is a schematic view of the instant invention.

SPECIFIC DESCRIPTION OF THE INVENTION

An apparatus for making a spun-consolidated nonwoven web 1 from continuous filaments 2, preferably of a thermoplastic synthetic resin, has a spinning device or spinneret 3 and, downstream therefrom in a filament-travel direction FD, a cooler 4. A stretcher 5 for stretching the filaments 2 follows the cooler 4 in the filament-flow direction FD. Preferably, this stretcher 5 has an intermediate passage 6 that converges in the direction of flow FD of the filaments 2, as well as an adjoining stretching passage 7. Recommendably, the assembly of the cooler 4 and the stretcher 5 is a closed system. Apart from the supply of cooling air or process air in the cooler 4, no further air supply is provided in this closed system. According to a preferred embodiment, a diffuser 8 is downstream of the stretcher 5 in the direction of flow FD of the filaments 2.

Advantageously, the filaments 2 are deposited downstream of the diffuser 8 on a screen deposition belt 9 to form the nonwoven web 1. Preferably, the screen deposition belt 9 circulates continuously to advance the mat 1 thus formed in a horizontal travel direction TD perpendicular to the vertical filament direction FD.

Recommendably, the deposited nonwoven web 1 is preconsolidated between two pressure rollers 11 in a preconsolidater 10. Advantageously, the preconsolidated nonwoven web 1 is then final consolidated in a calender 12 with a first upper calender roller 13 and a lower calender roller 14. The drawing shows that the first upper calender roller 13 is exchanged during an ongoing process operation for a second upper calender roller 15 (calender-roller exchange). The first upper calender roller 13 is pivoted away from the nonwoven web 1, and the second upper calender roller 15 in brought into contact with the lower calender roller 14 only thereafter. This results in a period of time in which no calendering of the nonwoven web 1 takes place. Accordingly, the transporting tension applied by the calendering apparatus 12 to the nonwoven web 1 drops. As a result, the other conveying components for the nonwoven web 1 must apply greater force, more particularly greater tension. This can result in damage or to tearing of the nonwoven web 1.

According to the invention, in order to remedy this situation, the preconsolidation of the nonwoven web 1 is increased during calender-roller exchange, and this increased preconsolidation is advantageously reduced again after the second upper calender roller 15 is installed.

In this embodiment according to the drawing, the preconsolidater 10 has two pressure rollers 11 that act on the nonwoven web 1. It lies within the scope of the invention for the preconsolidation to be increased with the pressure rollers 11 during calender-roller exchange. Preferably, the temperature and/or the compaction pressure of the pressure rollers 11 is increased for this purpose.

According to a preferred embodiment, the preconsolidater 10 has at least one additional preconsolidating component 17 that is activated during calender-roller exchange for additional preconsolidation of the nonwoven web 1. According to one embodiment according to the drawing, the additional preconsolidater can also be is a hot-air final consolidater 16 with which hot air is applied to the nonwoven web 1 during calender-roller exchange for additional preconsolidating. A spray nozzle 18 is also usable.

We claim:

1. A method of making a nonwoven web, the method comprising the steps of:

depositing fibers as a nonwoven web in a deposition area;

conveying the web along a path away from the deposition area in a web-travel direction;

preconsolidating the web in the path;

passing the preconsolidated web between a pair of rollers that compress and final consolidate the preconsolidated web;

separating one of the rollers from the web such that final consolidation of the web is stopped and at the same time or immediately beforehand increasing upstream preconsolidation of the web;

after separating the one roller from the web, bringing another roller into engagement with the web at the consolidation station and thereby recommencing final consolidation; and on recommencing of final consolidation, reducing upstream preconsolidation of the web.

2. The method defined in claim 1, wherein preconsolidation is effected with a predetermined level of compression of the nonwoven web and, during separation of the one roller from the web, the level of compression is increased.

3. The method defined in claim 1, further comprising the step of:

stretching the fibers prior to deposition.

4. The method defined in claim 1, wherein the fibers are continuous spun filaments deposited as a spun-consolidated nonwoven web or as a melt-blown nonwoven web.

5. The method defined in claim 1, wherein the preconsolidater has at least one pressure roller that bears on the nonwoven web with a pressure that is increased during calender-roller exchange by increasing a temperature and/or a compaction pressure or a line pressure of the pressure roller.

6. The method defined in claim 5, wherein the preconsolidater has at least one additional preconsolidating component that is activated against the nonwoven web during calender-roller exchange for additional preconsolidation of the nonwoven web.

7. The method defined in claim 5, wherein the at least one additional preconsolidating component is at least one press roller that is brought into contact with the nonwoven web during calender-roller exchange for additional preconsolidation of the nonwoven web.

8. The method defined in claim 5, wherein the at least one additional preconsolidating component is a spray adhesive applicator with which adhesive or spray adhesive is applied to the nonwoven web for additional preconsolidation of the nonwoven web.

9. The method defined in claim 5, wherein the at least one additional preconsolidating component projects hot air against the nonwoven web during calender-roller exchange for additional preconsolidation.

10. The method defined in claim 1, further comprising the step during calender-roller exchange of:

increasing a web-travel speed of the nonwoven web between the deposition area and a downstream receiving device for the nonwoven web.

11. The method defined in claim 10, wherein a rotational speed of at least a portion of a roller provided between the deposition area and the receiving device and in contact with the nonwoven web is increased during calender-roller exchange.

12. The method defined in claim 1, further comprising the step of:

winding a downstream end of the nonwoven web continuously in a compensator unit with at least one dancer roller during calender-roller exchange.

13. The method defined in claim 1, further comprising the step of:

monitoring a nonwoven web and controlling preconsolidation with or without feedback during calender-roller exchange.

14. The method defined in claim 1, further comprising the steps of:

using a screen deposition belt as a deposition area for the fibers, separating the nonwoven web from the screen deposition belt before transfer to the at least one calender roller, and assisting separation of the nonwoven web during calender-roller exchange by an additional stripper.

15. The method defined in claim 1, wherein at least one additional take-off roller activated during calender-roller exchange effects the separation of the nonwoven web from the screen deposition belt by contact with the nonwoven web, and the additional take-off roller contacts a cooling roll in order to cool the nonwoven web while forming a take-off nip for the nonwoven web.

* * * * *